United States Patent [19]

Croy

[11] 4,260,283

[45] Apr. 7, 1981

[54] DE-WATERING SYSTEM

[76] Inventor: Richard L. Croy, 1621 Clearwater Largo Rd., Clearwater, Fla. 33516

[21] Appl. No.: 57,646

[22] Filed: Jul. 16, 1979

[51] Int. Cl.[3] ..... E02B 11/00; E03B 3/18

[52] U.S. Cl. ..... 405/36

[58] Field of Search ..... 405/36, 39, 42, 43; 166/157, 158, 205, 236; 285/197, 237, 370, 371, 397, 398, 423, DIG. 16

[56] References Cited

U.S. PATENT DOCUMENTS

| | | | |
|---|---|---|---|
| 1,915,136 | 6/1933 | Share | 166/157 X |
| 3,540,223 | 11/1970 | Ebbe | 405/43 |
| 3,566,982 | 3/1971 | Share et al. | 405/36 X |
| 3,930,538 | 1/1976 | Brennan et al. | 166/205 |
| 4,099,749 | 7/1978 | Van Vliet | 285/398 |

*Primary Examiner*—David H. Corbin

*Attorney, Agent, or Firm*—Arthur W. Fisher, III

[57] ABSTRACT

A de-watering system of the type used to lower the water table by extracting water from below ground through the use of an elongated header conduit having a negative pressure placed thereon wherein a plurality of swing joints and well point assemblies are interconnected to the header conduit and jetted into the ground utilizing a forced stream of water to a predetermined depth. The well point assembly includes an outer strainer pipe disposed in surrounded, concentric relation to an inner down pipe wherein a plurality of slots are formed in the strainer pipe through which water passes into access with the distal open end of the down pipe. Water is drawn from the interior of the down pipe into the elongated header circuit to the point of ultimate disposition of the collected water.

7 Claims, 4 Drawing Figures

FIG. 1
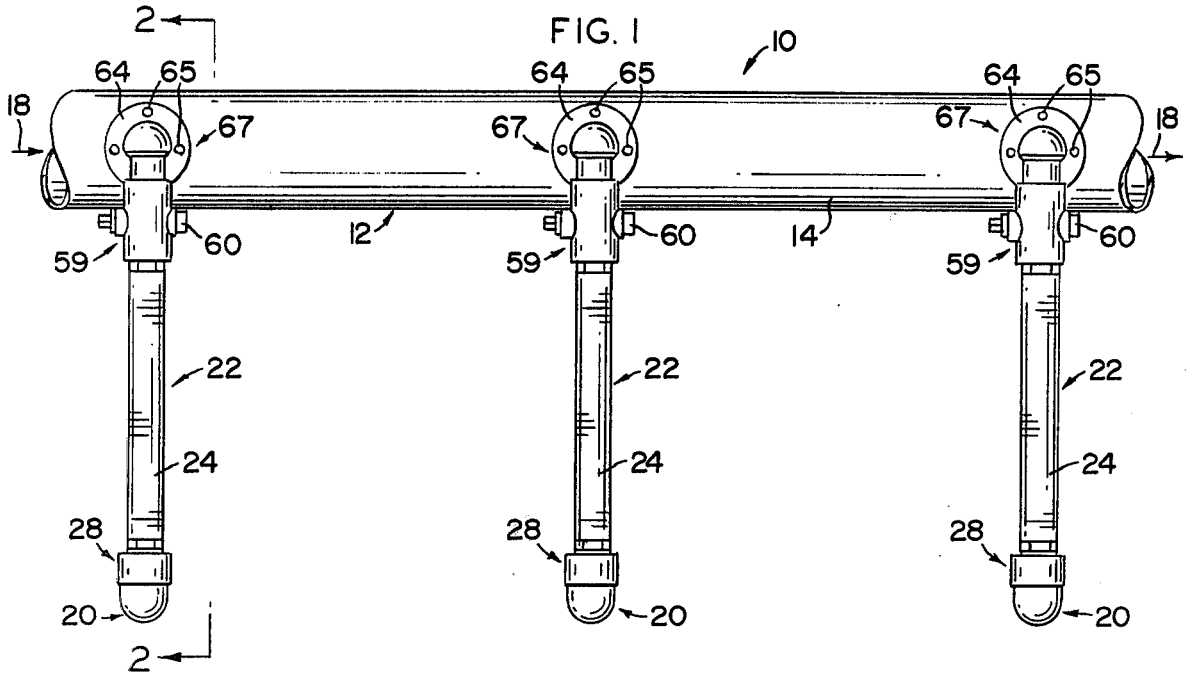
FIG. 2
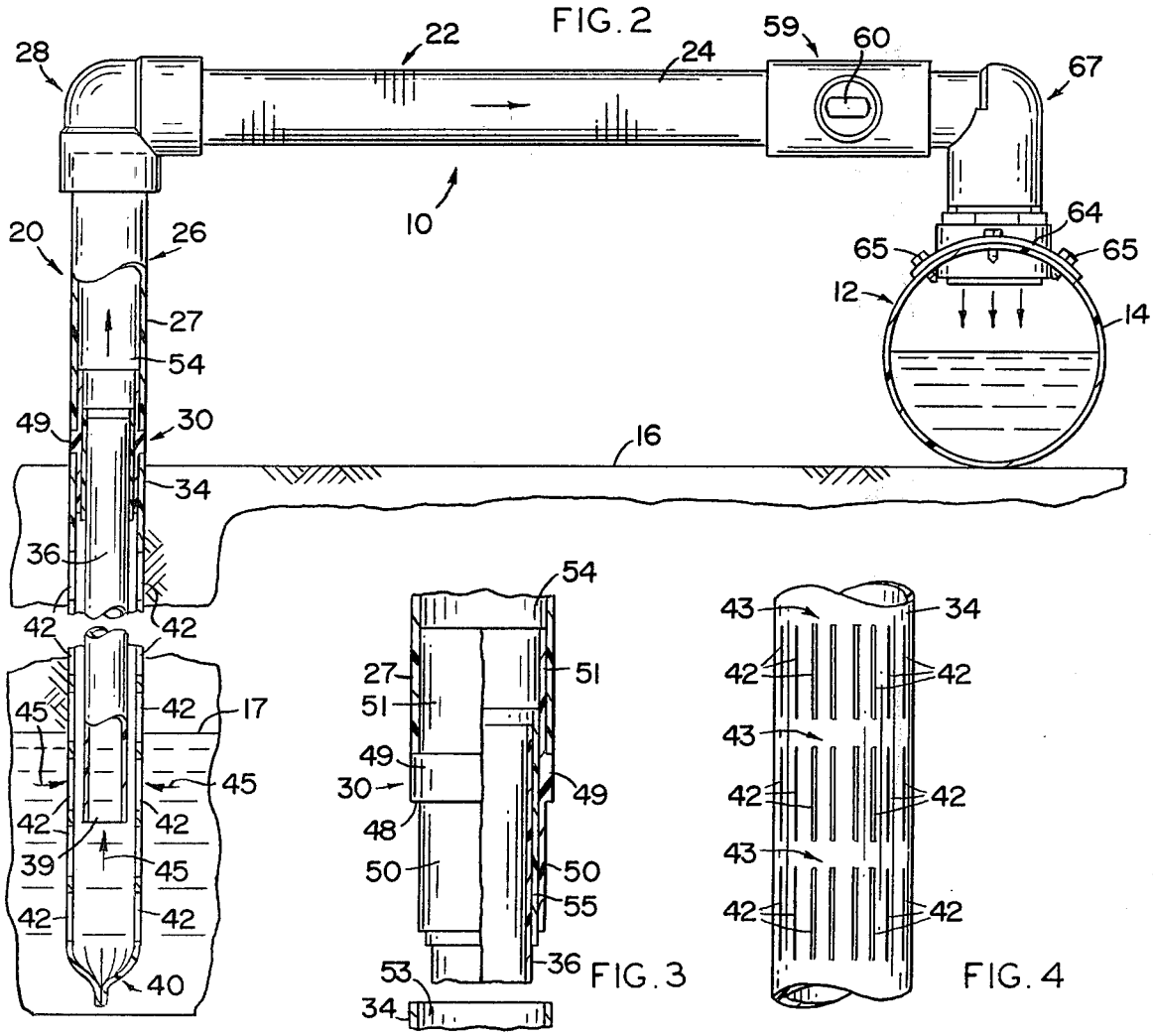
FIG. 3
FIG. 4

DE-WATERING SYSTEM

BACKGROUND OF THE INVENTION

1. Field of the Invention

This invention relates to a well point system for lowering the water table in a below ground location for purposes of completing excavation and irrigation wherein the individual well point assemblies may be readily placed at predetermined locations and at predetermined depths and removed by hand therefrom without the need of heavy removal equipment normally associated with well point installations.

2. Description of the Prior Art

Various water removal systems in the form of well assemblies are quite well known in the prior art and used for a number of purposes. Frequently, in the commercial construction industry geographic areas containing a relatively high water table are frequently encountered. Such water table must be often times lowered in order to permit the formation of adequate excavations. To accomplish this well systems and particularly well point assemblies are utilized to extract water out of various types of ground strata in numerous types of terrains. Such a well point assembly temporarily lowers the water table below the depth of intended excavation for the purpose of stabilizing dirt and preventing cave-ins, etc. Such lowering of the water table helps secure and maintain permanent installations of both construction and installed piping systems wherein grade and/or gravity flow is mandatory. Such systems are also used in excavating for foundations that require the curing of concrete or the utilization of steel that must be welded. Examples of such types of constructions include the installation of pilings, swimming pools density or compaction for roads or installations utilizing the boring of new pipe under existing preexisting roads.

The aforementioned well point assemblies are used for residential lawn irrigation, argricultrual irrigation, etc. In certain parts of the United States the subject well points are also used to provide relatively deeper well assemblies so as to provide drinking water to residential homes.

Conventionally, water removal systems of this type generally involve the use of steel or metallic conduits. Such installations have an outer, temporary casing extended into the ground for a predetermined depth for the purpose of actually inserting the metal well point at predetermined locations. Such installations are well known to be extremely time consuming and require large and expensive equipment. Such equipment frequently includes the use of a large jet pump and requisite quantities of large diameter pressure hose to provide large quantities of water to the area at which the well point is installed or positioned in the ground. These twelve inch steel punch casings are also utilized as well as the use of cranes to handle the aforementioned equipment. Also as many as nine men are frequently required to install one well and generally require about one hour to install four walls.

Also conventional well points frequently require the use of filtering sand, disposed to surround the outer casing for maximum filtering of the steel well point. In addition to the above noted problems of installation, removal of such well assemblies is also a major problem due at least in part to the outwardly extending couplings disposed to protrude outwardly from the outer skin of the installed well point element. Such outwardly extending couplings and projections on the surface of the well point become sand locked requiring the use of a front end loader or crane or like heavy equipment to pull the points mechanically from the ground. In addition to the expense and time consumed in using such equipment, such method frequently results in the breaking of the installed points due to the extreme pressure put thereon.

To the contrary, there is a long recognized need for a system which is cheaper, less expensive and time consuming to install and which allow the easy and efficient removal of the points from their embedded location once it is desired to remove the subject well point system. Accordingly, the design and structure of the components of a more efficient well point system should include a light weight but strong material and a smooth outer surface of the well point assembly which does not necessitate the prior installation of a casing or the like as is now common in the industry. In addition, such a system should be effectively self cleaning in preventing the clogging of the entire system through the use of means to prevent the straining of soil particles surrounding the individual well point assemblies and as an overall result, should yield more water of fluid.

SUMMARY OF THE INVENTION

This invention relates to a system for removing water from a below ground location for the purposes of lowering a water table utilizing a well point system.

The system comprises header means including an elongated header conduit having attached thereto at substantially equally spaced apart location from one another the plurality of well point assemblies.

Each well point assembly comprises a base means serving to interconnect the remainder of the assembly to the header conduit. As will be described in greater detail hereinafter interconnecting means in the form of header swing conduits or assemblies serve to interconnect the well point assembly to the interior of the header conduit in fluid communication therewith.

With regard to the well point assembly structure, an outer strainer pipe means is attached to the distal end of the base means. The base means itself comprises a riser pipe which has its exterior surface arranged in substantially flush relation to the exterior surface of the strainer pipe means. The strainer pipe means is embedded in a downwardly extended relation in the ground and extending from the surface at the general location of the riser pipe.

An important structural feature of the present invention comprises the inclusion in the well point assembly of an interior, concentrically located down pipe extending an interior fluid communication with the riser pipe and disposed in spaced apart relation on the interior of the strainer pipe. Intake of the water at the water level location takes place through an intake means defined by the open distal end of the down pipe. This distal end is spaced above and apart from the closed distal end of the strainer pipe means.

Inlet means in the form of elongated slots, arranged in annular bands along the length of the strainer pipe serve to filter out the incoming water based on the longitudinal and transverse dimension of the slot thereby avoiding clogging and providing a self-cleaning function as the sand particles are kept out.

Another important structural feature of the present invention is to provide provision of a coupling means in the form of a slip coupling serving to interconnect various sections of the strainer pipe to one another and specifically to the riser pipe. The slip coupling comprises two end portions segregated by an ouwardly protruding connecting collar. Plastic adhesive is used to secure the lower end portion of the slip coupling to the interior surface of the strainer pipe means simultaneously to the exterior surface of the down pipe means. This serves to direct the interior of the down pipe means in direct communication with the interior of the riser pipe and eventually the interior of the header conduit. The opposite end of the slip coupling is disposed on the interior of the riser pipe to maintain this fluid flow communication. The outwardly projecting angularly configured connecting collar is dimensioned and configured to be disposed substantially flushed with the exterior surface of the riser pipe and the exterior surface of the strainer pipe means to avoid any outward protrusions of the coupling or joint portion. This eliminates the problem of the entire well point assembly becoming sand locked after its insertion into the ground. Accordingly, removal of the well point assembly can be accomplished by hand in a minimal amount of time by a single person. This of course differs from the expensive, time consuming and damaging procedure of attempting to remove various well points using heavy type equipment such as is conventionally done in the industry at this time.

Other structural features of the present invention comprise the closing of the distal end of the strainer pipe means by twisting such closed end. Twisting can be accomplished by placing the end to be closed near a heating element of approximately 260° and slowly rotating the point until the point is soft enough to maintain a complete twist and permanent fashion therein. Once the twist has been completed the twisted and preheated end is placed in a cooling medium such as water for approximately 10 seconds so as to retain its shape. Excess protrusion from the twisted end can be cut off by a saw in a conventional fashion.

Alternately the end is closed by an end cap made of polyvinal chloride like material which is dimensioned to have its outer peripheral surface substantially disposed flushed with the outer peripheral surface of the strainer pipe means.

Yet other structural features of the present invention includes the head swing pipe or conduit assembly to be made of a flexible material such as a fuel hose or conduit which remains flexible regardless or temperature and allows ready connection of the junction end of the header swing conduit to the free end of the riser pipe. Also positioning of the well point assembly in the desired location is therefore facilitated by the flexibility or movable relation of the header swing conduit to the header conduit itself.

Another structural feature of the present invention with regards to installation and operation is that it takes only an average time of 45 seconds to place each well in comparison to the conventional system of 15 minutes per well. Also, it is frequent that a change in the depth of the well point will be needed only to compliment a greater result of need for extracting water. With the old conventional means, the steel riser pipe would be cut off, re-threaded and attached or deleted to reach the required length. This results in the loss of numerous hours. With the present invention, use of polynimal chloride for forming the riser pipe can be altered in seconds by means of a conventional saw or adding the internal slips to extend the length of the riser pipe.

A valve means may be used to regulate or cut off flow when water is ceased to be drawn from any individual well point rather than effecting the overall negative pressure or supply therefrom the valve is activated to close off a given well point.

This invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a top plane view in partial cutaway showing the water removal system including header conduit and individually attached well point assemblies.

FIG. 2 is a end view in partial section taken along line 2—2 of FIG. 1 showing detailed structural features of the well point assembly.

FIG. 3 is a view in partial section in detail showing structural features of the slip coupling element.

FIG. 4 is a detailed view in partial cutaway showing the inlet means in the form of a plurality of slots formed in the wall of the strainer pipe means.

Similar reference characters refer to similar parts throughout the several views of the drawings.

DETAILED DESCRIPTION OF THE PREFERRED EMBODIMENT

As shown in FIGS. 1 and 2 the system of the present invention is generally indicated as 10 and comprises header means 12 in the form of an elongated header conduit 14 disposed on the surface of a terrain being de-watered 16. A conventional pump means (not shown) serves to create a negative pressure within the interior of the header conduit 14 and caused fluid flow therein as indicated by directional arrows 18.

A well point assembly generally indicated as 20 is interconnected in fluid flow communication with the interior of the header conduit 14 by an interconnecting means generally indicated as 22 in the form of a header swing conduit 24. With regard to FIGS. 2, 3 and 4 the well point assembly comprises a base means generally indicated as 26 including a riser pipe 27 connected at one end to the distal junction point 28 of the interconnection means 22 and header swing conduit 24. The opposite end of the riser pipe 27 is attached to a coupling means (FIGS. 2 and 3) generally indicated as 30. As will be explained in greater detail hereinafter the coupling means 30 comprises a slip coupling which serves to connect both a outwardly disposed strainer pipe means 34 (FIG. 4) and an inwardly, concentrically disposed down pipe 36, to the riser pipe 27. The outwardly disposed strainer pipe means 34 extends downwardly from the riser pipe in penetrating relation to the ground 16 to a point below the believed water table 17. In addition the inwardly disposed down pipe 36 is also extended downwardly for fluid communication with the water table 17 to remove the water therefrom to preferrably an above ground location. The down pipe 36 includes an intake means 39 defined by the opened distal end of the down pipe. This open end is spaced apart and above from the closed distal end generally indicated as 40 of the strainer pipe means 34. Since the distal end as at 40 of the strainer pipe means is closed the water enters into the interior of the strainer pipe means 34 through intake through what inlet means comprising (FIG. 4) a plurality of elongated slots 42.

In the preferred embodiment the individual slots are arranged in spaced apart relation to one another and also disposed in angularly configured bands generally indicated as 43 extending in spaced apart relation to one another longitudinally along the length of the strainer pipe means 34. Each of the slots have a predetermined linear and transverse dimension dependent upon the soil in which the well points assembly is embedded. These slots perform a straining or filtering function which allows water to pass therethrough and eventually into the intake 39 of the downpipe 36 while at the same time extracting or stopping entrance of soil particles which could possibly cause clogging about the intake means 39. Such flow of water from the water table 17 as indicated by directional arrows 45.

Again with regard to FIGS. 2 and 3 the coupling means generally indicated as 30 comprises a slip coupling 48 including a connecting collar 49 protruding outwardly from the remaining outer surface of opposite end portions 50 and 51 and into substantially flush relation with the outer surface of the riser pipe 27 and the outer surface of the strainer pipe means 34. As set forth above this smooth outer surface configuration of the well point assembly prevents or eliminates sand locking and facilitates removal of the well point assembly from its embedded location. The distal end portion 50 of the slip coupling is adhesively secured to the inner surface 53 of the strainer pipe means 34 and also secured to the outer surface 55 of the down pipe means 36. The opposite end portion 51 is adhesively secured through the use of plastic securing cement or adhesive to the inner surface 54 of the riser pipe 27. This serves to establish free fluid communication between the interior of the down pipe 36 and the interior of the riser pipe 27 so as to establish a free fluid flow path of the water from the water table 17 through slots 42 pass intake means 39 up through down pipe 36, through header swing conduit 24 and eventually into the interior of the header conduit 14, as best shown in FIG. 2.

Other structural features of the present invention comprise the swing header conduit 24 being made from a flexible material and having a valve means 59 secured thereto so as to regulate fluid flow between the interior of the header conduit 14 and the interior of the well point assembly 20.

A saddle means 64 and a plurality of connector elements 65 are attached to the outer surface of the conduit 14 to secure the associated end 67 of the interconnecting means 22 thereto.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A de-watering system of the type used to extract water from a below ground surface water table, said system comprising: header means disposed above ground, a plurality of well point assemblies interconnected to said header means at spaced apart locations from one another along a length of said header means in fluid communication therewith; at least one of said well point assemblies comprising base means interconnected to said header means, strainer pipe means extending from said base means downwardly into the ground to the water table, down pipe means concentrically disposed on the interior of said strainer pipe means and extending downwardly therein along a major portion of the length of said strainer pipe means, intake means defined by an open distal end of the down pipe means, said intake means disposed in spaced relation above the distal end of said strainer pipe means, said strainer pipe means comprising inlet means extending along the lengeth thereof and including the predetermined dimension efficient to prevent entrance of soil particles to said intake means, said base means comprises a riser pipe disposed in interconnecting relation with both said said down pipe means and said strainer pipe means on one end thereof and said header means on the opposite end thereof, a coupling means disposed in connected relation at one end thereof to said riser pipe and at the other end thereof to both said strainer pipe means and said down pipe means, said strainer pipe means and said down pipe means beng concentrically disposed relative to one another, said coupling means comprises a slip coupling element comprising one end portion mounted on the interior of said riser pipe and the opposite end portion concurrently secured to the exterior of said down pipe means and the interior of said strainer pipe means and thereby establish fluid communication between said riser pipe and said down pipe means, whereby liquid is transferred under negative pressure from the water table to said header means, said coupling means further including an enlarged annular mid-portion formed between said end portions disposed to position the outer surface thereof in substantially flush relation to the outer surfaces of said riser pipe and said strainer pipe means.

2. A system as in claim 1 wherein said inlet means comprises a plurality of elongated slots formed in the wall of said strainer pipe means and each having a predetermined linear and transverse dimension dependent upon the soil type in which said well point assembly is disposed, a predetermined number of said slots arranged in annular shaped bands, each of said bands disposed in longitudinally spaced apart relation to one another and each slot in each band disposed in equally spaced relation to one another, whereby water enters the interior of said strainer pipe means and said intake means through said inlet means.

3. A system as in claim 1 further comprising interconnection means disposed in interconnected fluid communicating relation between said base means and said header means in comprising a header swing assembly including a flexible material conduit movably interconnected between said header means and said base means, whereby said well point assembly is positioned in laterally spaced apart relation from the longitudinal axis of said header means.

4. A system as in claim 1 further comprising valve means disposed to regulate fluid flow between said header means and said well point assembly, whereby negative pressure from said header means and any of said well point assemblies may be stopped.

5. A system as in claim 3 further comprising swing attachment means comprising a saddle attachment mounted on the exterior of said header means and disposed to establish fluid communication between the interior of said header means and said swing assembly.

6. A system as in claim 1 wherein said header means comprises an elongated header conduit extended over a predetermined length of ground surface, a plurality of access apertures disposed in spaced apart relation from one another at substantially equally spaced intervals, swing header assemblies connected to each of said apertures at one end thereof and to said base means at the opposite end thereof.

7. A system as in claim 1 wherein each strainer pipe means comprises a closed distal end defined by the wall portion thereof twisted about itself in a closed configuration.

* * * * *